United States Patent [19]

Halse

[11] 4,168,851

[45] Sep. 25, 1979

[54] CONTINUOUS BUSINESS FORMS ASSEMBLY

[75] Inventor: Per W. Halse, Oslo, Norway

[73] Assignee: Moore Business Forms, Inc.

[21] Appl. No.: 885,190

[22] Filed: Mar. 10, 1978

Related U.S. Application Data

[63] Continuation of Ser. No. 727,518, Sep. 28, 1976, abandoned.

[51] Int. Cl.[2] ..... B41L 1/20

[52] U.S. Cl. ..... 282/11.5 A; 282/20 R

[58] Field of Search ..... 282/11.5 R, 11.5 A, 282/12 R, 19 R, 20 R

[56] References Cited

U.S. PATENT DOCUMENTS

| | | | |
|---|---|---|---|
| 2,400,356 | 5/1946 | Kerr et al. | 282/24 R |
| 2,503,680 | 4/1950 | Newman | 282/19 R |
| 2,907,585 | 10/1959 | Sornberger et al. | 282/11.5 A |
| 4,000,916 | 1/1977 | Lucas | 282/11.5 A |
| 4,121,857 | 10/1978 | Halse | 282/11.5 A |

FOREIGN PATENT DOCUMENTS

| | | | |
|---|---|---|---|
| 1172283 | 6/1964 | Fed. Rep. of Germany | 282/11.5 A |
| 501396 | 2/1939 | United Kingdom | 282/11.5 A |

*Primary Examiner*—Robert L. Spicer, Jr.

*Attorney, Agent, or Firm*—Watson, Cole, Grindle & Watson

[57] ABSTRACT

A series-connected business form is adapted to be fed through the printing means of a business machine and includes a continuous pair of superimposed outer webs each having a row of spaced superimposed feed holes extending along at least one marginal edge thereof for engagement with the feed means of the business machine so that the form may be thereby advanced into and past the printing means. At least one intermediate web is disposed between the outer webs with transfer material lying on opposite sides of such intermediate web, and the intermediate web is secured to only one of the outer webs. The webs are divided by transverse lines of weakening so that the form is separable into individual units, and the one web and its attached intermediate web is removable from the remainder of each unit so that, upon the printing of a number of such units, the next to the last of such units so printed may be separated along the transverse lines of weakening whereafter the one web and its intermediate web secured thereto of the last of such units may be separated from the other of such webs to leave such other web of the last unit available as a drive web for initiating the feed of the remaining units to be printed.

3 Claims, 4 Drawing Figures

CONTINUOUS BUSINESS FORMS ASSEMBLY

This is a continuation, of application Ser. No. 727,518 filed Sept. 28, 1976, now abandoned.

BACKGROUND OF THE INVENTION

Various types of continuous business forms are available for being fed to the printing means of business machines such as typewriters, tabulators, mini-computers, or the like. Such forms may be in the nature of manifolding assemblies including superimposed paper webs interleaved with carbon transfer sheets. Typical of such assemblies are shown in U.S. Pat. No. 2,907,585 and in British Pat. No. 1,376,447 which include rows of spaced marginal feed holes. Many of the continuous business forms are used with office computers and terminal printers and are intended to be used for relatively short runs. When such forms or assemblies are positioned in the print unit of the computer, the feed holes at opposite marginal edges thereof engage the feed pins of a pair of tractor pin feed units at the outfeed side of the print unit. Therefore, as the tractors are driven, the stationery assemblies advance into and past the print unit. However, it becomes necessary to position the tractors several inches downstream of the printing position in the direction of feed through the machine in order to effectively and accurately advance the assembly. As a consequence, each time a fresh continuous assembly to be printed is loaded into the front print unit, one form length at the leading end of the assembly is wasted since it is disposed slightly downstream of the print position in order to engage with the tractor units. Hence, such form length at the leading edge of the assembly must be discarded at the end of the print run.

This waste each time a new pack of forms is loaded into the print unit is compounded when relatively short lengths of the forms are printed, especially if a single form length only is to be printed because during each printing operation a partly used pack is inserted and this entails losing one form length at each reloading.

SUMMARY OF THE INVENTION

It is therefore an object of the present invention to provide a continuous business forms assembly of improved construction which will avoid wasting a form length each time the assembly is fed into the print unit of a business machine.

In accordance with the invention the continuous business forms assembly includes superimposed continuous webs with the outer webs being secured together along at least one marginal edge thereof and having rows of superimposed feed holes in the webs for engagement with the feed means of the business machine so that the form may be thereby advanced into and past the printing means. An intermediate web between the outer webs and transfer sheets on opposite sides of the intermediate webs are secured together but only to one of the outer webs, such one outer web being detachable from the assembly so that, upon separation thereof together with its attached intermediate webs, the other of the outer webs of the assembly is left for forming a drive web for a fresh run of an assembly through the printer.

DETAILED DESCRIPTION OF THE INVENTION

Figure 1:
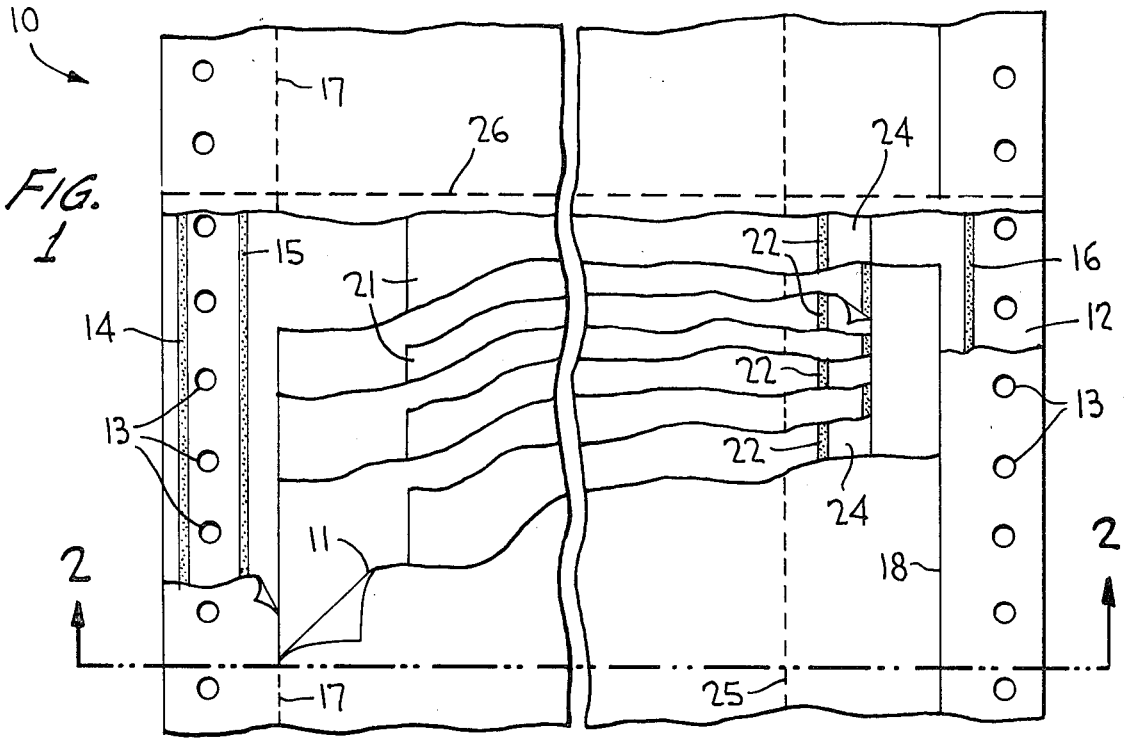
FIG. 1 is a plan view showing a part of the continuous business forms assembly according to the invention, partly broken away to illustrate the details thereof.
Figure 2:
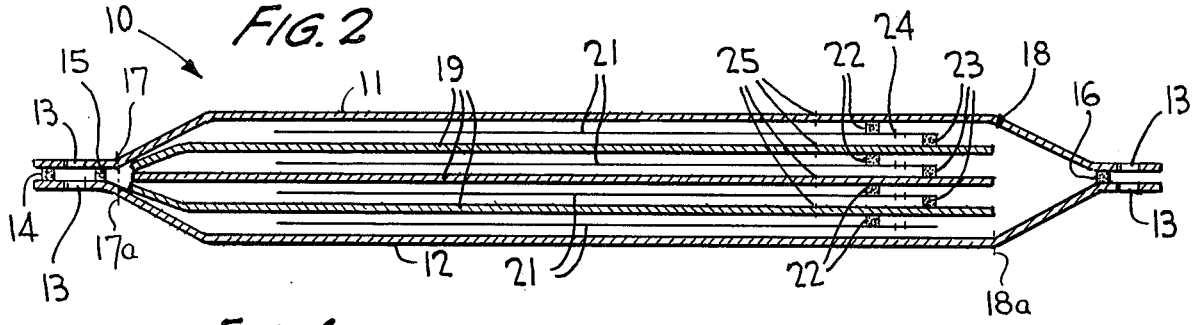
FIG. 2 is a cross-sectional view of the assembly taken substantially along line 2—2 of FIG. 1.

Turning now to the drawings wherein like reference characters refer to like and corresponding parts throughout the several views, a continuous business forms assembly is generally designated 10 in FIGS. 1 and 2 and comprises continuous upper and lower webs 11 and 12 overlying one another and having substantially the same width. Rows of spaced feed holes 13 are provided in outer webs 11 and 12 along opposite marginal edges respectively in axial alignment as shown. Longitudinal lines of adhesive 14, 15 and 16 are provided adjacent the rows of feed holes for securing the outer webs together at their marginal edges. A longitudinal line of perforations 17 is provided only in upper web 11 slightly inwardly of line 15 of adhesive. Also, the upper web is longitudinally slit as along line 18 which lies slightly inwardly of line 16 of adhesive. It should be noted, however, that a line of perforations similar to 17 could be provided in web 11 in lieu of longitudinal slit 18 without departing from the scope of the invention.

A plurality of intermediate webs 19 are superimposed between outer webs 11 and 12, with carbon transfer sheets 21 lying on opposite sides of the intermediate webs. As can be seen, the intermediate webs extend slightly outwardly of the edges of the carbon transfer sheets and lie adjacent line 17 of perforations. Also, the intermediate webs are secured to the upper web via an overlying transfer sheet. For example, the transfer sheets are secured to the webs overlying them by means of superimposed lines 22 of adhesive. And, the transfer sheets are secured only to their underlying intermediate webs along lines 23 of adhesive spaced a slight distance away from lines 22 of adhesive.

The transfer sheets are slit as at 24 in a diagonal or herringbone fashion and are disposed between lines 22 and 23 of adhesive. Similarly as in U.S. Pat. No. 2,907,585, these flexing cuts produce a natural hinging effect combined with the staggered lines 22 and 23 of gluing thereby permitting a substantial amount of free relative longitudinal movement of all the parts of the assembly. The inherent fanning of the assembly parts as they pass about a feed or platen cylinder is thereby not hampered by this fastening means since the assembly parts are capable of realigning themselves in registry.

Upper web 11 and each of the intermediate webs 19 are provided with superimposed longitudinal lines 25 of perforations located slightly inwardly of glue lines 22. Also, transverse lines 26 of perforations are spaced along the form and lie superimposed in all the parts of the assembly so as to permit the form to be separated into individual units U after the assembly has been run through the printer.

Figure 4:
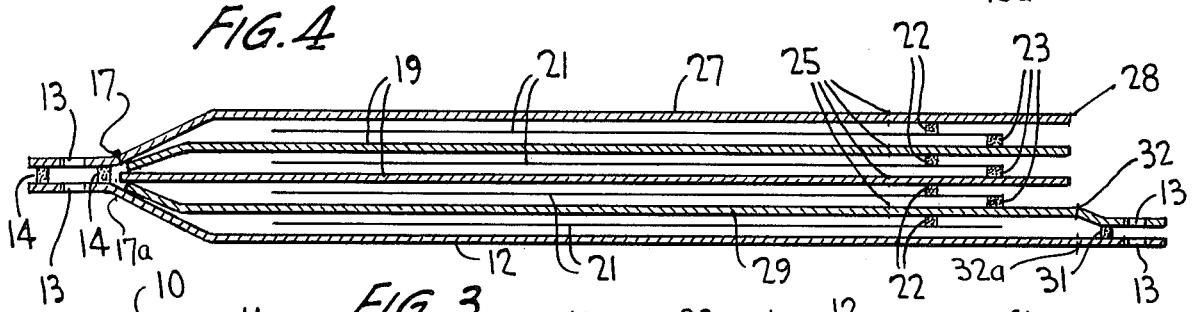
FIG. 4 is a sectional view similar to FIG. 2 of another embodiment of the invention.

FIG. 4 shows a modification of the FIGS. 1 and 2 construction as having an upper web 27 which differs from web 11 in that it is not provided with a row of feed holes at opposite marginal edges thereof. Instead, web 27 has its marginal edge 28 in alignment with the marginal edges of all but the bottommost intermediate ply lying therebeneath as clearly shown in FIG. 4. Such bottommost intermediate web 29, instead, has a marginal edge provided with a row of spaced feed holes 13 respectively in alignment with holes 13 provided at the right-hand end of outer web 12. Webs 29 and 12 are secured together along a longitudinal line 31 of adhesive lying adjacent superimposed feed holes 13. And similarly as provided for the upper web in the FIG. 2 embodiment, a longitudinal line 32 of perforations is provided in intermediate web 29 slightly inwardly of line 31 of adhesive. The outer parts and their interconnections of the FIG. 4 construction are otherwise the same as in FIG. 2. It should be noted, however, that lines 22 and 23 of adhesive in both embodiments may be replaced by lines of securement wherein paper staples such as those illustrated in British Pat. No. 1,676,447 are used.

Figure 3:
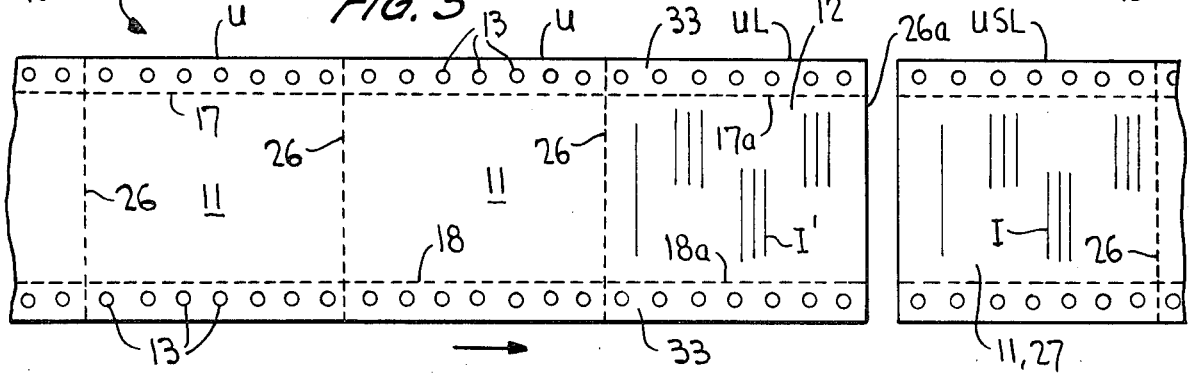
FIG. 3 is a plan view at a reduced scale of the assembly of FIG. 1 shown with one of the outer webs and its attached intermediate webs removed from the other of the outer webs to thereby provide a drive web for an assembly to be fed through the printer.

In operation, the assembly is advanced past the printing unit of the business machine as in the direction of the arrow shown in FIG. 3 as the feed pins of the tractors engage feed holes 13 along opposite marginal edges thereof. After the form is printed with indicia I and is fed by the tractor pin feed devices to the outfeed side of the tractors, a predetermined length of various connected printed units U are separated from the unprinted assembly along a transverse line 26 of weakening. And, depending on the particular printing operation the printed units may have been individually burst from the printed assembly so as to be separated along line 26 by the time a printed unit it separated along line 26*a*. As shown in FIG. 3, this printed unit comprises the second to the last printed unit USL, the last printed unit UL remaining connected to the unprinted assembly. However, web 11 together with webs 19 of the FIG. 2 embodiment are removed from the remainder of unit UL along line 17 of perforations and along transverse lines 26 located in these webs. And, if a line of perforations is provided in lieu of slit line 18, web 11 is likewise separated along such line. Similarly, webs 27, 19 and 29 of the FIG. 4 embodiment are removed from unit UL by tearing along lines 17 and 32 as well as along their respective transverse lines 26. Lower web 12 is therefore now exposed and remains connected to the leading unprinted unit U of the unprinted assembly. This exposed lower web has images I' of the indicia transferred thereto which may serve as a record sheet from this particular unit. Also, feed strips 33 remain attached to the lower web, these feed strips being defined by portions of web 11 (FIG. 2) extending outwardly of lines 17 and 18 upon removal of webs 11 and 19 as aforedescribed. Otherwise, feed strips 33 are defined by a portion of web 27 (FIG. 4) and a portion of web 29 extending outwardly of respective lines 17 and 32. Unit UL thereby serves as a drive unit for the unprinted assembly at such time as the assembly is to be printed during a subsequent printing run. The feed holes of drive unit UL are strengthened by reason of feed strips 33. The entire assembly may be removed from the business machine and, when the assembly is reloaded thereinto, the leading unit is unit UL rather than an unprinted unit U so that the entire assembly may be now advanced through the printing unit of the business machine without wasting the leading unit since unit UL may subsequently be separated from the reloaded assembly without being discarded since it serves as a record sheet for the last printed unit of the prior run.

It should be noted that, upon removal of webs 11 and 19 from lower web 12 as in FIG. 2, these webs may be separated from the interleaved transfer sheets simply by grasping with one hand outwardly of the free edge of the transfer sheets and with the other hand outwardly of lines 25 and snapping in opposite directions. Webs 27, 19 and 29 may be similarly separated from the interleaved transfer sheets upon separation of these webs from bottom web 12.

Obviously many other modifications and variations of the present invention are made possible in the light of the above teachings. For example, carbonless transfer material of the standard variety may be coated on some or all the mating surfaces of the webs for the transfer of images between the outer webs in lieu of carbon transfer sheets as described. Also, lower webs 12 may be provided with longitudinal lines of weakening 17*a*, 18*a* underlying lines 17 and 18 in FIG. 2 and lines 17*a* and 32*a* underlying lines 17 and 32 in FIG. 4. Feed strips 33 may therefore also be removed from lower webs 12 after the printed assembly is burst into individual units to thereby provide clean record sheets without feed strips.

It is therefore to be understood that within the scope of the appended claims the invention may be practiced otherwise than as specifically described.

What is claimed is:

1. A series-connected business form adapted to be fed through the printing means of a business machine, comprising, a continuous pair of superimposed outer webs having longitudinal feed strips along opposite marginal edges thereof, said feed strips including spaced feed holes for engaging the feed means of the business machine so that the business form may be thereby advanced into and past the printing means, said outer webs being directly connected together along longitudinal first and second connecting means respectively lying adjacent said feed holes, one of said webs having longitudinal first and second lines of weakening respectively spaced inwardly of said first and second connecting means, at least one continuous intermediate web disposed between said outer webs and having opposed free marginal edges respectively disposed inwardly of said first and second connecting means and respectively lying adjacent said first and second lines of weakening, said intermediate web being connected to only said one outer web along longitudinal third connecting means lying inwardly of one of said first and second lines of weakening, and said webs having spaced transverse lines of weakening in superimposed relationship for separating the form therealong into individual units, whereby upon the printing of a number of said units, the next to the last of said units so printed may be separated along one of said superimposed transverse lines of weakening whereafter said one web and said intermediate web connected thereto of the last of said units so printed may be removed by separation along said superimposed transverse lines of weakening and along said first and second lines of weakening from the other of said outer webs thereby leaving said other web of said last unit together with said feed strips thereon available as a drive web for initiating the feed of the remaining units to be advanced into and past the printing means.

2. The business form according to claim 1, wherein only said one outer web has a longitudinal third line of weakening therein spaced inwardly of said third connecting means, and said intermediate web having a longitudinal fourth line of weakening aligned with said third line of weakening, whereby said one and said intermediate webs may each be separated along said third and fourth lines after the removal thereof from said other web.

3. The business form according to claim 1, wherein a plurality of intermediate webs are disposed between said outer webs and have opposed free marginal edges respectively lying adjacent said first and second lines of weakening, adjacent intermediate webs being interconnected together.

* * * * *

REEXAMINATION CERTIFICATE (650th)

United States Patent [19] [11] B1 4,168,851

Halse [45] Certificate Issued Mar. 17, 1987

[54] CONTINUOUS BUSINESS FORMS ASSEMBLY

[75] Inventor: Per W. Halse, Oslo, Norway

[73] Assignee: Moore Business Forms, Inc.

Reexamination Request:
No. 90/000,859, Sep. 17, 1985

Reexamination Certificate for:

| | |
|---|---|
| Patent No.: | **4,168,851** |
| Issued: | **Sep. 25, 1979** |
| Appl. No.: | **885,190** |
| Filed: | **Mar. 10, 1978** |

Related U.S. Application Data

[63] Continuation of Ser. No. 727,518, Sep. 28, 1976, abandoned.

[51] Int. Cl.[4] ..... B41L 1/20
[52] U.S. Cl. ..... 282/11.5 A; 282/20 R
[58] Field of Search ..... 282/11.5 R, 11.5 A, 282/12 R, 20 R; 229/69

[56] References Cited

U.S. PATENT DOCUMENTS

| | | |
|---|---|---|
| 2,178,103 | 10/1979 | Johnson . |
| 2,328,081 | 8/1943 | Johnson . |
| 2,400,356 | 5/1946 | Kerr et al. . |
| 2,503,680 | 4/1950 | Newman . |
| 2,907,585 | 10/1959 | Sornberger et al. . |
| 3,104,799 | 9/1963 | Steidinger . |
| 3,305,247 | 2/1967 | Fulk . |
| 3,339,827 | 9/1967 | Steidinger . |
| 3,554,438 | 1/1971 | Van Maldergham . |
| 3,854,654 | 12/1984 | Van Maldergham . |
| 3,877,728 | 4/1975 | Herz . |
| 3,916,051 | 10/1975 | Wakeman . |
| 3,941,308 | 3/1976 | DiGirolomo et al. . |
| 4,000,916 | 1/1977 | Lucas . |
| 4,002,290 | 1/1977 | Van Maldergham . |
| 4,032,065 | 6/1977 | Heimann . |
| 4,095,695 | 6/1978 | Steidinger . |
| 4,108,352 | 8/1978 | Peschke . |
| 4,113,281 | 9/1978 | Halse . |
| 4,121,857 | 10/1978 | Halse . |
| 4,123,086 | 10/1978 | French . |
| 4,168,851 | 9/1979 | Halse . |
| 4,178,018 | 12/1979 | Halse . |

FOREIGN PATENT DOCUMENTS

| | | |
|---|---|---|
| 829450 | 1/1952 | Fed. Rep. of Germany . |
| 1042612 | 11/1958 | Fed. Rep. of Germany . |
| 974026 | 8/1960 | Fed. Rep. of Germany . |
| 1105889 | 5/1961 | Fed. Rep. of Germany . |
| 1172283 | 6/1964 | Fed. Rep. of Germany . |
| 1174807 | 7/1964 | Fed. Rep. of Germany . |
| 1256659 | 12/1967 | Fed. Rep. of Germany . |
| 1957983 | 5/1971 | Fed. Rep. of Germany . |
| 1461492 | 12/1966 | France . |
| 97462 | 2/1961 | Norway . |
| 126673 | 3/1973 | Norway . |
| 501396 | 2/1939 | United Kingdom . |
| 919496 | 2/1963 | United Kingdom . |
| 988148 | 4/1965 | United Kingdom . |
| 1006662 | 10/1965 | United Kingdom . |
| 1128634 | 9/1968 | United Kingdom . |
| 1154048 | 6/1969 | United Kingdom . |
| 1221969 | 2/1971 | United Kingdom . |
| 1286864 | 8/1972 | United Kingdom . |
| 1329063 | 9/1973 | United Kingdom . |
| 1376447 | 12/1974 | United Kingdom . |
| 1417683 | 12/1975 | United Kingdom . |
| 1418379 | 12/1975 | United Kingdom . |

*Primary Examiner*—Paul A. Bell

[57] ABSTRACT

A series-connected business form is adapted to be fed through the printing means of a business machine and includes a continuous pair of superimposed outer webs each having a row of spaced superimposed feed holes extending along at least one marginal edge thereof for engagement with the feed means of the business machine so that the form may be thereby advanced into and past the printing means. At least one intermediate web is disposed between the outer webs with transfer material lying on opposite sides of such intermediate web, and the intermediate web is secured to only one of the outer webs. The webs are divided by transverse lines of weakening so that the form is separable into individual units, and the one web and its attached intermediate web is removable from the remainder of each unit so that, upon the printing of a number of such units, the next to the last of such units so printed may be separated along the transverse lines of weakening whereafter the one web and its intermediate web secured thereto of the last of such units may be separated from the other of such webs to leave such other web of the last unit available as a drive web for initiating the feed of the remaining units to be printed.

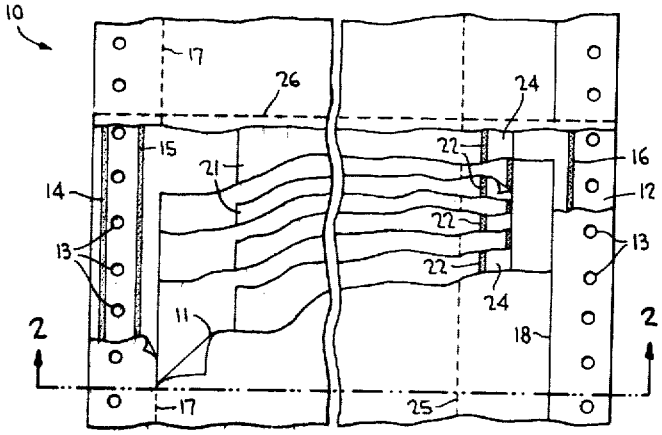

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 2 is confirmed.

Claims 1 and 3 are cancelled.

* * * * *